United States Patent [19]

Hamilton

[11] Patent Number: 4,633,851

[45] Date of Patent: Jan. 6, 1987

[54] PORTABLE HOT AIR CIRCULATOR

[76] Inventor: Ray V. Hamilton, 8224 Wolf Run Shoals Rd., Clifton, Va. 22024

[21] Appl. No.: 801,913

[22] Filed: Nov. 26, 1985

[51] Int. Cl.[4] ..... F24H 3/06

[52] U.S. Cl. ..... 126/110 AA; 126/96; 126/110 C; 126/84; 165/122

[58] Field of Search ..... 126/84, 96, 110 A, 110 AA, 126/110 B, 110 C, 110 D; 237/55; 165/121–124

[56] References Cited

U.S. PATENT DOCUMENTS

| | | | |
|---|---|---|---|
| 1,276,886 | 8/1918 | Eberhardt | 126/96 |
| 1,301,324 | 4/1919 | Schlatter | 126/110 C |
| 1,380,135 | 5/1921 | Corbin, Jr. | 126/110 AA |
| 3,880,140 | 4/1975 | Scogin | 126/110 B |
| 4,392,478 | 7/1983 | Black | 126/84 |
| 4,396,001 | 8/1983 | Ogino et al. | 126/96 |
| 4,458,666 | 7/1984 | Osada | 126/110 B |

FOREIGN PATENT DOCUMENTS

| | | | |
|---|---|---|---|
| 558249 | 12/1943 | United Kingdom | 126/110 C |

*Primary Examiner*—Samuel Scott
*Assistant Examiner*—Allen J. Flanigan
*Attorney, Agent, or Firm*—I. J. Crickenberger

[57] ABSTRACT

A portable hot air circulator comprises concentrically mounted cylindrical members, the inner member being closed at its upper end to form a cup-like structure designed to mount over a conventional liquid fuel heater in closely-spaced relation. Air is forced downwardly through an annular passageway between the cylindrical members by a fan mounted through the top of the outer cylindrical member which is closed to form a plenum space between the tops of the concentric cylinder members. The fan is shielded by a louvered hood member, and spacer clips accomodate the mounting over the liquid fuel heater.

4 Claims, 3 Drawing Figures

PORTABLE HOT AIR CIRCULATOR

BACKGROUND OF THE INVENTION

There are numerous liquid fuel heating devices on the market. A popular form of such device is the portable kerosene heater, although gasoline and other liquid fuel heaters are commonly available. These heaters are relatively inexpensive to purchase, and fuel is commonly available and inexpensive. The compact size and portability of these heaters make them particularly attractive for outdoor uses such as camping, and for vacation homes and other structures without central heating. They may used in conjunction with a central heating system to provide heat for seldom used rooms in which the central heat is normally turned off.

The typical liquid fuel heater is a "gravity" heater; i.e., it depends upon convection currents induced by the action of gravity to heat the ambient air. This type of operation does not furnish heat as efficiently or as quickly as forced-air circulators in which the heated air is circulated by a fan or similar device. The ideal manner in which to create heating comfort is to provide a device that continuously draws in colder air to be heated, and then discharges the warmed air at floor level to be recirculated until the heating requirements are satisfied.

BRIEF SUMMARY OF THE INVENTION

The present invention provides a compact, portable device which adapts existing gravity heating units to operate more efficiently as forced-air type units. The device comprises inner and outer cylindrical members which are mounted concentrically in spaced relationship defining an annular passageway therebetween. The inner cylindrical member has one end completely closed-off by a circular plate. The other end is fastened to the outer cylindrical member by means of a first flat annulus having a plurality of holes spaced therearound. The first flat annulus closes the annular passageway between the cylindrical members, except for the holes therein.

The end of the outer cylindrical member opposite to the first flat annulus is closed-off by a second flat annulus which has a fan mounted within its central aperture. The device is positioned over a conventional liquid fuel heater, the top of the heater extending up into the inner cylindrical member.

In operation the fan draws air from the surrounding atmosphere and forces it down through the annular passageway between the cylindrical members, where it is warmed by the liquid fuel heater prior to being blown through the holes in the first annulus back into the surrounding atmosphere.

DETAILED DESCRIPTION OF THE INVENTION

Figure 1:
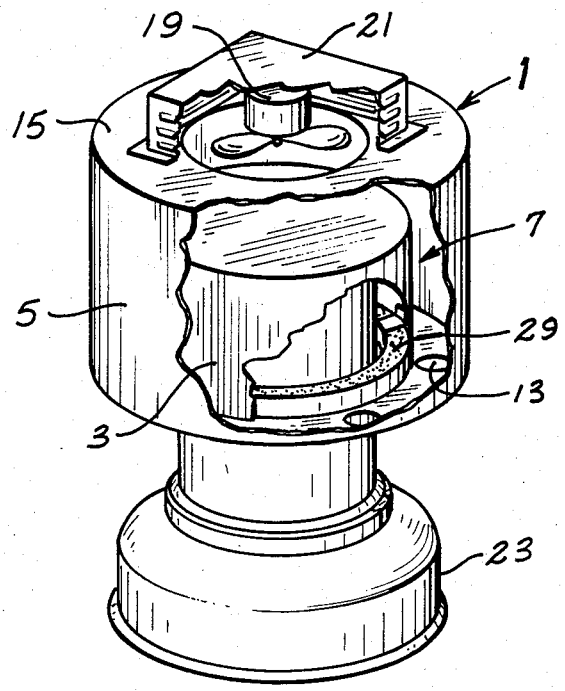
FIG. 1 is a front perspective view of the portable air circulator mounted on a conventional liquid fuel heater.
Figure 2:
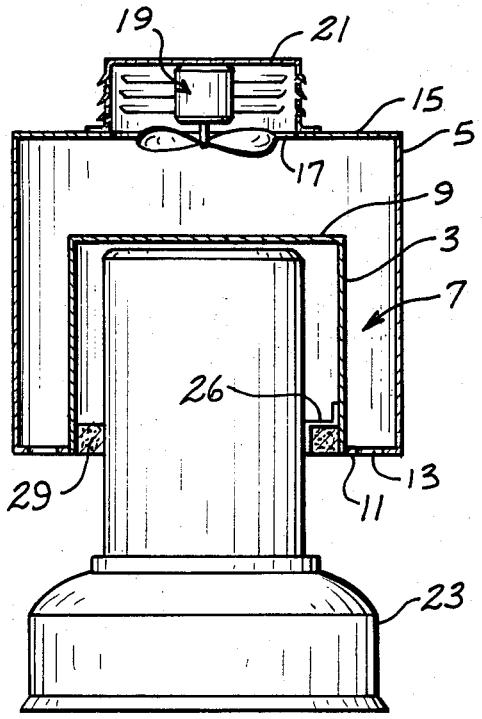
FIG. 2 is a vertical section taken through the circulator shown in FIG. 1 of this invention.
Figure 3:
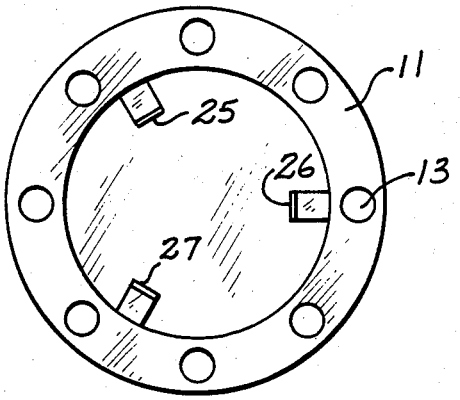
FIG. 3 is a bottom plan view showing the lower portion of the circulator.

The invention will be understood more readily by referring to the drawings in which FIG. 1 is a perspective view showing the device of the invention mounted in position on a conventional liquid fuel heater. The hot air circulator is shown generally at 1, and comprises an inner cylindrical member 3 mounted concentrically within an outer cylindrical member 5 to define an annular passageway 7 between them. The inner cylindrical member 3 has a circular plate member 9 which closes one end. A first flat annulus 11 is positioned between inner and outer cylindrical members at their bottom portions as shown. A plurality of holes, such as shown at 13, provide for air flow between the annular passageway 7 and the surrounding atmosphere.

The top portion of outer cylindrical member 5 is closed by a second flat annulus 15 which has a central aperture adapted to receive a fan 19 mounted therein. Fan 19 is connected to a suitable source of electrical energy (not shown) such as a household electrical system or an automotive battery, depending upon the designed usage. A hood member 21 is utilized as a mounting and as a protective shield for the fan 19.

The circulator 1 is mounted on a conventional liquid fuel heater 23 by placing the inner cylindrical member 3 over the top of the heater 23. The circulator 1 is spaced from and held in position around the heater 23 by means of spacing clips 25, 26, 27. An annular charcoal filter element 29 is positioned between the heater 23 and the inner cylindrical member 3 to filter out any impurities which may be present in the space between the upper portion of heater 23 and the cylindrical member 3.

In operation the fan 19 draws in air from the surrounding atmosphere and forces it through passageway 7, through the holes, such as 13, in the first flat annulus 11, and back into the surrounding atmosphere. The discharge of heated air is effected downwardly from the bottom of the unit and thereby provides heat where it is most needed at floor-level. The air discharged at floor level gives immediate room comfort while mixing with color air near the walls and ceiling, which in turn is forced to recirculate by means of the fan 19.

Another advantage provided by the device of this invention is portability. Besides using domestic electrical current, energy to operate the circulating fan can also be supplied by batteries, so that the portable unit, when set in place on a gravity heating system, can be operated with the same degree of efficiency in remote places.

What is claimed is:

1. A portable hot air circulator for use in combination with a conventional liquid fuel gravity heater comprising a first cylindrical member having one end thereof closed by a circular plate to form an inverted cup-like structure;

a second cylindrical member positioned concentrically around the first cylindrical member;

a first flat annulus joining the bottom portions of the first and second cylindrical members to form an annular passageway therebetween, said first flat annulus having a plurality of holes spaced therearound to provide air flow therethrough;

a second flat annulus connected to the top portion of the second cylindrical member to define a space between the said second flat annulus and the circular plate;

a fan member mounted on the top side of the second flat annulus and positioned over the central aperture of the annulus;

whereby the circulator, when mounted in position on a conventional liquid fuel gravity heater, will operate by drawing in ambient air and force the air through the annular passageway to be heated by the heater and then discharged through the holes in the first annulus to the surrounding atmosphere at floor-level.

2. The combination according to claim 1 comprising a hood member mounted on the top surface of the second flat annulus, said fan member being mounted on the underside of the hood member;

whereby the hood member serves as a mounting and a protective shield for the fan member.

3. The combination according to claim 1 comprising spacer clip members mounted around the inner surface of the first cylindrical member near the bottom thereof;

whereby the spacer clip members serve to hold the circulator in position on the conventional heater in spaced relationship therefrom.

4. The combination according to claim 3 comprising an annular filter element mounted between the first cylindrical member and the conventional heater, said filter element being held in position by said spacer clip members.

* * * * *